US006016471A

United States Patent [19]

Kuhn et al.

[11] Patent Number: 6,016,471

[45] Date of Patent: Jan. 18, 2000

[54] METHOD AND APPARATUS USING DECISION TREES TO GENERATE AND SCORE MULTIPLE PRONUNCIATIONS FOR A SPELLED WORD

[75] Inventors: Roland Kuhn; Jean-Claude Junqua; Matteo Contolini, all of Santa Barbara, Calif.

[73] Assignee: Matsushita Electric Industrial Co., Ltd., Osaka, Japan

[21] Appl. No.: 09/067,764

[22] Filed: Apr. 29, 1998

[51] Int. Cl.[7] ..... G10L 5/04

[52] U.S. Cl. ..... 704/266; 704/267; 704/270

[58] Field of Search ..... 704/266, 267, 704/270

[56] References Cited

U.S. PATENT DOCUMENTS

| | | | |
|---|---|---|---|
| 5,679,001 | 10/1997 | Russell et al. | 434/185 |
| 5,715,367 | 2/1998 | Gillick et al. | 704/254 |
| 5,791,904 | 8/1998 | Russell et al. | 434/185 |
| 5,794,197 | 8/1998 | Alleva et al. | 704/255 |

OTHER PUBLICATIONS

Lalit R. Bahl, et al. "Decision Trees for Phonological Rules in Continuous Speech," Proc. ICASSP 91, p. 185–188, Apr. 1991.

Roland Kuhn, et al. "Improved Decision Trees for Phonetic Modeling," Proc. ICASSP 95, p. 552–555, May 1995.

Thierry Dutoit, An Introduction to Text–To–Speech Synthesis, Kluwer Academic Publishers, sections 4.2.3.1 and 5.4.3, 1997.

*Primary Examiner*—David R. Hudspeth
*Assistant Examiner*—Tálivaldis Ivars Šmits
*Attorney, Agent, or Firm*—Harness, Dickey & Pierce, P.L.C.

[57] ABSTRACT

The mixed decision tree includes a network of yes-no questions about adjacent letters in a spelled word sequence and also about adjacent phonemes in the phoneme sequence corresponding to the spelled word sequence. Leaf nodes of the mixed decision tree provide information about which phonetic transcriptions are most probable. Using the mixed trees, scores are developed for each of a plurality of possible pronunciations, and these scores can be used to select the best pronunciation as well as to rank pronunciations in order of probability. The pronunciations generated by the system can be used in speech synthesis and speech recognition applications as well as lexicography applications.

13 Claims, 2 Drawing Sheets

METHOD AND APPARATUS USING DECISION TREES TO GENERATE AND SCORE MULTIPLE PRONUNCIATIONS FOR A SPELLED WORD

BACKGROUND AND SUMMARY OF THE INVENTION

The present invention relates generally to speech processing. More particularly, the invention relates to a system for generating pronunciations of spelled words. The invention can be employed in a variety of different contexts, including speech recognition, speech synthesis and lexicography.

Spelled words accompanied by their pronunciations occur in many different contexts within the field of speech processing. In speech recognition phonetic transcriptions for each word in the dictionary are needed to train the recognizer prior to use. Traditionally phonetic transcriptions are manually created by lexicographers who are skilled in the nuances of phonetic pronunciation of the particular language of interest. Developing a good phonetic transcription for each word in the dictionary is time consuming and requires a great deal of skill. Much of this labor and specialized expertise could be dispensed with if there were a reliable system that could generate phonetic transcriptions of words based on their letter spelling. Such a system could extend current recognition systems to recognize words such as geographic locations and surnames that are not currently found in existing dictionaries.

Spelled words are also encountered frequently in the speech synthesis field. Present day speech synthesizers convert text to speech by retrieving digitally-sampled sound units from a dictionary and concatenating these sound units to form sentences.

As the above examples demonstrate, both the speech recognition and the speech synthesis fields of speech processing would benefit from the ability to generate accurate pronunciations from spelled words. The need for this technology is not limited to speech processing, however. Lexicographers have today completed fairly large and accurate pronunciation dictionaries for many of the major world languages. However, there still remain many hundreds of regional languages for which good phonetic transcriptions do not exist. Because the task of producing a good phonetic transcription has heretofore been largely a manual one, it may be years before some regional languages will be transcribed, if at all. The transcription process could be greatly accelerated if there were a good computer-implemented technique for scoring transcription accuracy. Such a scoring system would use an existing language transcription corpus to identify those entries in the transcription prototype whose pronunciations are suspect. This would greatly enhance the speed at which a quality transcription is generated.

Heretofore most attempts at spelled word-to-pronunciation transcription have relied solely upon the letters themselves. These techniques leave a great deal to be desired. For example, a letter-only pronunciation generator would have great difficulty properly pronouncing the word Bible. Based on the sequence of letters only the letter-only system would likely pronounce the word "Bib-l", much as a grade school child learning to read might do. The fault in conventional systems lies in the inherent ambiguity imposed by the pronunciation rules of many languages. The English language, for example, has hundreds of different pronunciation rules, making it difficult and computationally expensive to approach the problem on a word-by-word basis.

The present invention addresses the problem from a different angle. The invention uses a specially constructed mixed-decision tree that encompasses both letter sequence and phoneme sequence decision-making rules. More specifically, the mixed-decision tree embodies a series of yes-no questions residing at the internal nodes of the tree. Some of these questions involve letters and their adjacent neighbors in a spelled word sequence; other of these questions involve phonemes and their neighboring phonemes in the word sequence. The internal nodes ultimately lead to leaf nodes that contain probability data about which phonetic pronunciations of a given letter are most likely to be correct in pronouncing the word defined by its letter sequence.

The pronunciation generator of the invention uses this mixed-decision tree to score different pronunciation candidates, allowing it to select the most probable candidate as the best pronunciation for a given spelled word. Generation of the best pronunciation is preferably a two-stage process in which a letter-only tree is used in the first stage to generate a plurality of pronunciation candidates. These candidates are then scored using the mixed-decision tree in the second stage to select the best candidate.

Although the mixed-decision tree is advantageously used in a two-stage pronunciation generator, the mixed tree is useful in solving some problems that do not require letter-only first stage processing. For example, the mixed-decision tree can be used to score pronunciations generated by linguists using manual techniques.

For a more complete understanding of the invention, its objects and advantages, reference may be had to the following specification and to the accompanying drawings.

DESCRIPTION OF THE PREFERRED EMBODIMENTS

Figure 1:
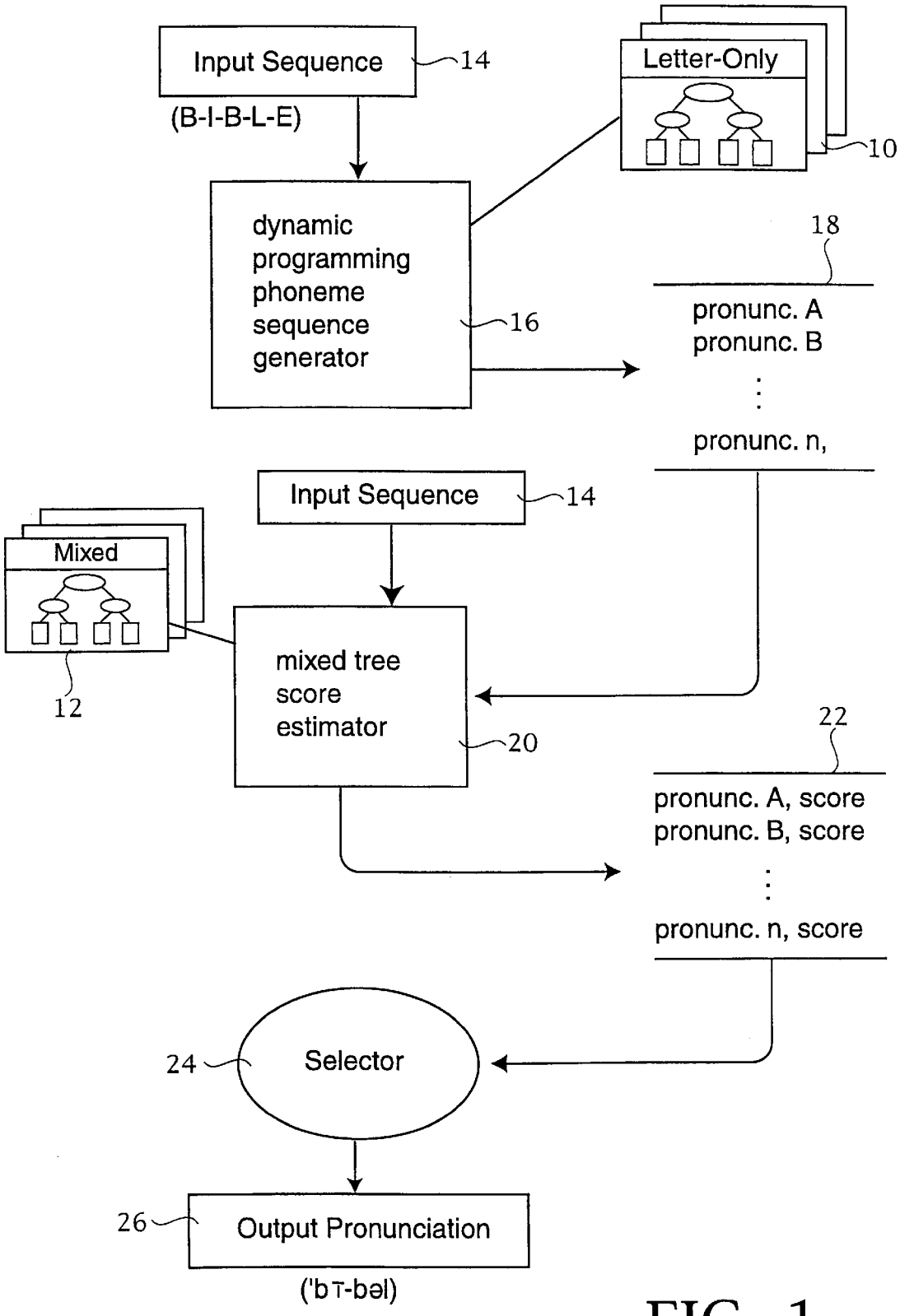
FIG. 1 is a block diagram illustrating the components and steps of the invention.

To illustrate the principles of the invention the exemplary embodiment of FIG. 1 shows a spelled letter-to-pronunciation generator. As will be explained more fully below, the mixed-decision tree of the invention can be used in a variety of different applications in addition to the pronunciation generator illustrated here. The pronunciation generator has been selected for illustration because it highlights many aspects and benefits of the mixed-decision tree structure.

The pronunciation generator employs two stages, the first stage employing a set of letter-only decision trees 10 and the second stage employing a set of mixed-decision trees 12. An input sequence 14, such as the sequence of letters B-I-B-L-E, is fed to a dynamic programming phoneme sequence generator 16. The sequence generator uses the letter-only trees 10 to generate a list of pronunciations 18, representing possible pronunciation candidates of the spelled word input sequence.

The sequence generator sequentially examines each letter in the sequence, applying the decision tree associated with that letter to select a phoneme pronunciation for that letter based on probability data contained in the letter-only tree.

Figure 2:
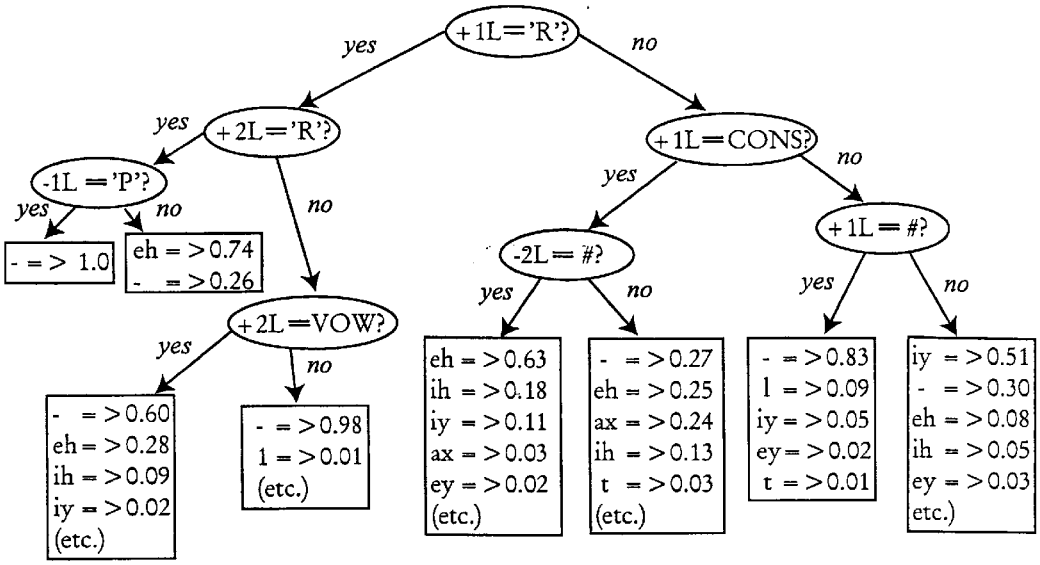
FIG. 2 is a tree diagram illustrating a letter-only tree.

Preferably the set of letter-only decision trees includes a decision tree for each letter in the alphabet. FIG. 2 shows an example of a letter-only decision tree for the letter E. The decision tree comprises a plurality of internal nodes (illustrated as ovals in the Figure) and a plurality of leaf nodes (illustrated as rectangles in the Figure). Each internal node is populated with a yes-no question. Yes-no questions are questions that can be answered either yes or no. In the letter-only tree these questions are directed to the given letter (in this case the letter E) and its neighboring letters in the input sequence. Note in FIG. 2 that each internal node branches either left or right depending on whether the answer to the associated question is yes or no.

Abbreviations are used in FIG. 2 as follows: numbers in questions, such as "+1" or "−1" refer to positions in the spelling relative to the current letter. For example, "+1L== 'R'?" means "Is the letter after the current letter (which in this case is the letter E) an R?" The abbreviations CONS and VOW represent classes of letters, namely consonants and vowels. The absence of a neighboring letter, or null letter, is represented by the symbol -, which is used as a filler or placeholder where aligning certain letters with corresponding phoneme pronunciations. The symbol # denotes a word boundary.

The leaf nodes are populated with probability data that associate possible phoneme pronunciations with numeric values representing the probability that the particular phoneme represents the correct pronunciation of the given letter. For example, the notation "iy=>0.51" means "the probability of phoneme 'iy' in this leaf is 0.51." The null phoneme, i.e., silence, is represented by the symbol '-'.

The sequence generator 16 (FIG. 1) thus uses the letter-only decision trees 10 to construct one or more pronunciation hypotheses that are stored in list 18. Preferably each pronunciation has associated with it a numerical score arrived at by combining the probability scores of the individual phonemes selected using the decision tree 10. Word pronunciations may be scored by constructing a matrix of possible combinations and then using dynamic programming to select the n-best candidates. Alternatively, the n-best candidates may be selected using a substitution technique that first identifies the most probable word candidate and then generates additional candidates through iterative substitution, as follows.

The pronunciation with the highest probability score is selected first, by multiplying the respective scores of the highest-scoring phonemes (identified by examining the leaf nodes) and then using this selection as the most probable candidate or first-best word candidate. Additional (n-best) candidates are then selected by examining the phoneme data in the leaf nodes again to identify the phoneme, not previously selected, that has the smallest difference from an initially selected phoneme. This minimally-different phoneme is then substituted for the initially selected one to thereby generate the second-best word candidate. The above process may be repeated iteratively until the desired number of n-best candidates have been selected. List 18 may be sorted in descending score order, so that the pronunciation judged the best by the letter-only analysis appears first in the list.

As noted above, a letter-only analysis will frequently produce poor results. This is because the letter-only analysis has no way of determining at each letter what phoneme will be generated by subsequent letters. Thus a letter-only analysis can generate a high scoring pronunciation that actually would not occur in natural speech. For example, the proper name, Achilles, would likely result in a pronunciation that phoneticizes both II's: ah-k-ih-I-I-iy-z. In natural speech, the second I is actually silent: ah-k-ih-I-iy-z. The sequence generator using letter-only trees has no mechanism to screen out word pronunciations that would never occur in natural speech.

The second stage of the pronunciation system addresses the above problem. A mixed-tree score estimator 20 uses the set of mixed-decision trees 12 to assess the viability of each pronunciation in list 18. The score estimator works by sequentially examining each letter in the input sequence along with the phonemes assigned to each letter by sequence generator 16.

Figure 3:
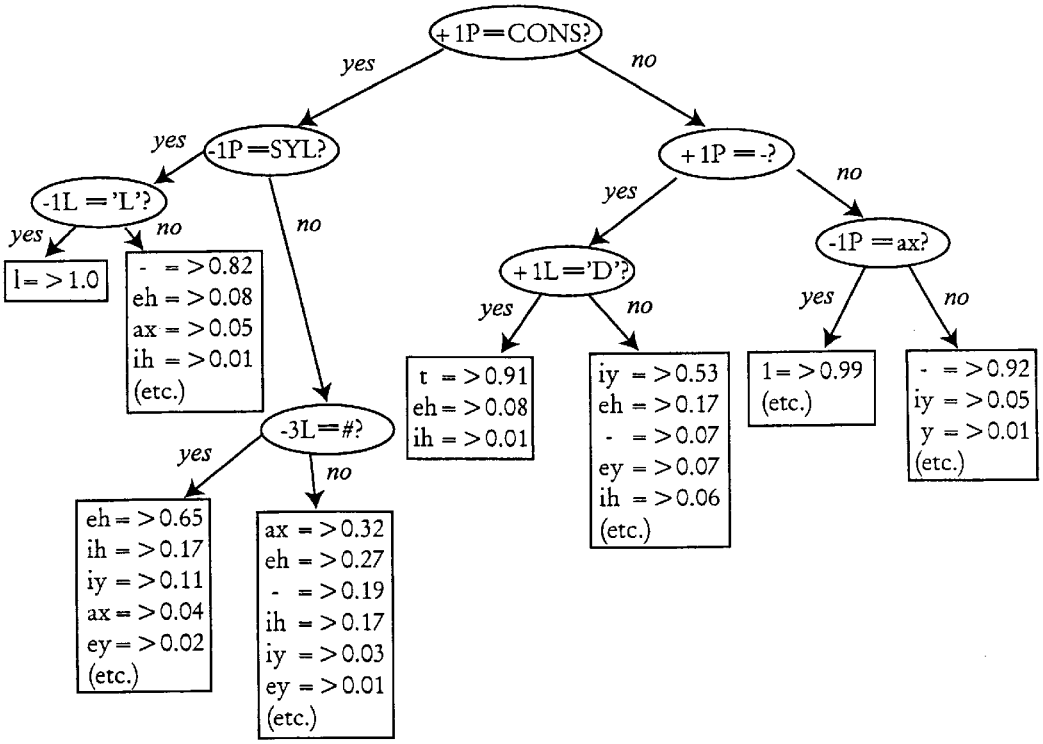
FIG. 3 is a tree diagram illustrating a mixed tree in accordance with the invention.

Like the set of letter-only trees, the set of mixed trees has a mixed tree for each letter of the alphabet. An exemplary mixed tree is shown in FIG. 3. Like the letter-only tree, the mixed tree has internal nodes and leaf nodes. The internal nodes are illustrated as ovals and the leaf nodes as rectangles in FIG. 3. The internal nodes are each populated with a yes-no question and the leaf nodes are each populated with probability data. Although the tree structure of the mixed tree resembles that of the letter-only tree, there is one important difference. The internal nodes of the mixed tree can contain two different classes of questions. An internal node can contain a question about a given letter and its neighboring letters in the sequence, or it can contain a question about the phoneme associated with that letter and neighboring phonemes corresponding to that sequence. The decision tree is thus mixed, in that it contains mixed classes of questions.

The abbreviations used in FIG. 3 are similar to those used in FIG. 2, with some additional abbreviations. The symbol L represents a question about a letter and its neighboring letters. The symbol P represents a question about a phoneme and its neighboring phonemes. For example the question "+1L=='D'?" means "Is the letter in the +1 position a 'D'?" The abbreviations CONS and SYL are phoneme classes, namely consonant and syllabic. For example, the question "+1P==CONS?" means "Is the phoneme in the +1 position a consonant?" The numbers in the leaf nodes give phoneme probabilities as they did in the letter-only trees.

The mixed-tree score estimator rescores each of the pronunciations in list 18 based on the mixed-tree questions and using the probability data in the lead nodes of the mixed trees. If desired, the list of pronunciations may be stored in association with the respective score as in list 22. If desired, list 22 can be sorted in descending order so that the first listed pronunciation is the one with the highest score.

In many instances the pronunciation occupying the highest score position in list 22 will be different from the pronunciation occupying the highest score position in list 18. This occurs because the mixed-tree score estimator, using the mixed trees 12, screens out those pronunciations that do not contain self-consistent phoneme sequences or otherwise represent pronunciations that would not occur in natural speech.

If desired a selector module 24 can access list 22 to retrieve one or more of the pronunciations in the list. Typically selector 24 retrieves the pronunciation with the highest score and provides this as the output pronunciation 26.

As noted above, the pronunciation generator depicted in FIG. 1 represents only one possible embodiment employing the mixed tree of the invention. As an alternative embodiment, the dynamic programming phoneme sequence generator 16, and its associated letter-only decision trees 10 may be dispensed with in applications where one or more pronunciations for a given spelled word sequence are already available. This situation might be encountered where a previously developed pronunciation dictionary is available. In such case the mixed-tree score estimator 20, with its associated mixed trees 12, may be used to score the entries in the pronunciation dictionary, identifying those having low scores, thereby flagging suspicious pronunciations in the dictionary being constructed. Such a system may, for example, be incorporated into a lexicographer's productivity tool.

The output pronunciation or pronunciations selected from list 22 can be used to form pronunciation dictionaries for both speech recognition and speech synthesis applications. In the speech recognition context, the pronunciation dictionary may be used during the recognizer training phase by supplying pronunciations for words that are not already found in the recognizer lexicon. In the synthesis context the pronunciation dictionaries may be used to generate phoneme sounds for concatenated playback. The system may be used, for example, to augment the features of an E-mail reader or other text-to-speech application. The mixed-tree scoring system of the invention can be used in a variety of applications where a single one or list of possible pronunciations is desired. For example, in a dynamic on-line dictionary the user types a word and the system provides a list of possible pronunciations, in order of probability. The scoring system can also be used as a user feedback tool for language learning systems. A language learning system with speech recognition capability is used to display a spelled word and to analyze the speaker's attempts at pronouncing that word in the new language, and the system tells the user how probable or improbable his or her pronunciation is for that word.

While the invention has been described in its presently preferred form it will be understood that there are numerous applications for the mixed-tree pronunciation system. Accordingly, the invention is capable of certain modifications and changes without departing from the spirit of the invention as set forth in the appended claims.

We claim:

1. An apparatus for generating at least one phonetic pronunciation for an input sequence of letters selected from a predetermined alphabet, comprising:

a memory for storing a plurality of letter-only decision trees corresponding to said alphabet, said letter-only decision trees having internal nodes representing yes-no questions about a given letter and its neighboring letters in a given sequence;

said memory further storing a plurality of mixed decision trees corresponding to said alphabet, said mixed decision trees having a first plurality of internal nodes representing yes-no questions about a given letter and its neighboring letters in said given sequence and having a second plurality of internal nodes representing yes-no questions about a phoneme and its neighboring phonemes in said given sequence, said letter-only decision trees and said mixed decision trees further having leaf nodes representing probability data that associates said given letter with a plurality of phoneme pronunciations;

a phoneme sequence generator coupled to said letter-only decision tree for processing an input sequence of letters and generating a first set of phonetic pronunciations corresponding to said input sequence of letters;

a score estimator coupled to said mixed decision tree for processing said first set to generate a second set of scored phonetic pronunciations, the scored phonetic pronunciations representing at least one phonetic pronunciation of said input sequence.

2. The apparatus of claim 1 wherein said second set comprises a plurality of pronunciations each with an associated score derived from said probability data and further comprising a pronunciation selector receptive of said second set and operable to select one pronunciation from said second set based on said associated score.

3. The apparatus of claim 1 wherein said phoneme sequence generator produces a predetermined number of different pronunciations corresponding to a given input sequence.

4. The apparatus of claim 1 wherein said phoneme sequence generator produces a predetermined number of different pronunciations corresponding to a given input sequence and representing the n-best pronunciations according to said probability data.

5. The apparatus of claim 4 wherein said score estimator rescores said n-best pronunciations based on said mixed decision trees.

6. The apparatus of claim 1 wherein said sequence generator constructs a matrix of possible phoneme combinations representing different pronunciations.

7. The apparatus of claim 6 wherein sequence generator selects the n-best phoneme combinations from said matrix using dynamic programming.

8. The apparatus of claim 6 wherein sequence generator selects the n-best phoneme combinations from said matrix by iterative substitution.

9. The apparatus of claim 1 further comprising a speech recognition system having a pronunciation dictionary used for recognizer training and wherein at least a portion of said second set populates said dictionary to supply pronunciations for words based on their spelling.

10. The apparatus of claim 1 further comprising a speech synthesis system receptive of at least a portion of said second set for generating an audible synthesized pronunciation of words based on their spelling.

11. The apparatus of claim 10 wherein said speech synthesis system is incorporated into an e-mail reader.

12. The apparatus of claim 10 wherein said speech synthesis system is incorporated into a dictionary for providing a list of possible pronunciations in order of probability.

13. The apparatus of claim 1 further comprising a language learning system that displays a spelled word and analyzes a speaker's attempt at pronouncing that word using at least one of said letter-only decision tree and said mixed decision tree to tell the speaker how probable his or her pronunciation was for that word.

* * * * *